United States Patent [19]

Catallo

[11] 4,175,738

[45] Nov. 27, 1979

[54] HORIZONTAL FOLDER WITH VARYING SPEED TRAVERSE

[76] Inventor: Frank Catallo, 84 Wheatley Rd., Old Westbury, N.Y. 11568

[21] Appl. No.: 876,982

[22] Filed: Feb. 13, 1978

[51] Int. Cl.[2] ..... B65H 29/46

[52] U.S. Cl. ..... 270/30

[58] Field of Search ..... 270/30–31, 270/61 F, 79

[56] References Cited

U.S. PATENT DOCUMENTS

| | | | |
|---|---|---|---|
| 2,820,630 | 1/1958 | Schwartz | 270/79 |
| 3,165,311 | 1/1965 | Mitchell | 270/79 |
| 3,735,223 | 5/1973 | Fort | 270/30 |

*Primary Examiner*—S. Edgar Burr
*Assistant Examiner*—A. Heinz
*Attorney, Agent, or Firm*—Thomas E. Tate

[57] ABSTRACT

The disclosure is that of an invention directed to a folder for a continuously advancing web of textile material in which a transverse guide roll assembly provided with a pair of parallel guide rolls is bodily reciprocated horizontally along a supporting frame. The guide rolls are positively driven in the same opposed directions at all times; and the speed of bodily reciprocation of the guide roll assembly is progressively reduced as that assembly approaches the end of each stroke of reciprocation in order to avoid a slack or bunched condition of the web in the central portion of each fold.

13 Claims, 7 Drawing Figures

HORIZONTAL FOLDER WITH VARYING SPEED TRAVERSE

THE INVENTION

This invention relates generally to new and useful improvements in apparatus for folding web materials for zig-zag or fan folding a continuously advancing web under such conditions that each fold is deposited into or onto a receiver as a uniform layer or ply with no slack or bulging in the central portion thereof.

Heretofore, most folders for this purpose have been either of the type employing a guide roll mounted on an oscillating frame overlying a table or other receiver upon or into which the web is folded, or of the type employing a pair of horizontal guide rolls that are adapted to be bodily reciprocated by chain drives, to which the folder of this invention generally relates.

Typical examples of the latter type of folder ae disclosed in U.S. Pat. Nos. 2,761,678, granted Sept. 4, 1956; 3,534,952, granted Oct. 20, 1970; 3,790,156, granted Feb. 5, 1974; and in this inventor's U.S. Pat. application Ser. No. 783,171, filed Mar. 31, 1977, now U.S. Pat. No. 4,074,901, granted Feb. 21, 1978.

Although the constructions of the above-mentioned patents and patent application vary substantially from one another, they all have certain features in common in that the fabric web is introduced over a rotating draw roll and led downwardly between a pair of guide rolls that are bodily reciprocated or traversed along a horizontal plane and in that the guide rolls are frictionally driven in the same opposed directions regardless of the direction of bodily reciprocation.

FUrther, even though those prior types of folders have been commercially acceptable, it has been observed that their performances have been somewhat deficient in two respects, namely that it is preferable to have the guide rolls positively driven, as here, and that the geometry of the fabric delivery to the receiver should be adjusted, as here, in order to avoid a slack or bunched condition in the central portion of each fold or ply.

In general, the first problem is solved, in accordance with this invention, by mounting a pair of gear-driven guide rolls upon a horizontally reciprocable carriage or assembly that is reciprocated by yoke and slide connections with a pair of constantly driven endless chains and the guide rolls are positively and continuously driven in the same opposite directions by a gear that moves with the carriage and its slidably mounted upon a constantly rotating drive shaft of square or polygonic cross-section disposed in parallelism with the path of travel of the gear-connected guide rolls.

Also, in general, the second and more difficult problem is solved, in accordance with this invention, by reciprocating the guide roll carriage or assembly in such a manner that the speed of traverse is normal through the central portion of each stroke and is progressively accelerated from and reduced to the stop at each end of each stroke, thus compensating for the progressive variations in the distances between an upper draw roll and the traversing guide roll assembly as that assembly reciprocates and assuring a uniform distribution of each fold or ply onto the receiver without any centrally located slack or bunching.

Therefore, an object of this invention is to provide a novel zig-zag or fan fold folder for a continuously advancing web of textile material in which the web is fed over an upper horizontal draw roll and downwardly between a pair of horizontal, positively driven, guide rolls that are bodily reciprocated or traversed by operable connections to a constantly driven endless chain.

Another object of this invention is to provide a folder of the character stated in which guide rolls are mounted on a reciprocable carriage or assembly and in which an end of each guide roll is provided with a bevel gear for driven engagement with a twin bevel gear that moves with the carriage and is slidably mounted on a continuously rotating drive shaft of square or polygonic cross-section whereby to positively and independently drive the guide rolls in the same opposed directions regardless of the direction of traverse of the carriage.

Another object of this invention is to provide a folder of the character stated that includes means for progressively slowing the speed of traverse of the carriage as the carriage approaches its stop at the end of each traverse stroke and for progressively increasing the speed of traverse at the beginning of each stroke whereby to effect a uniform deposition of each fold of the web onto the receiver without any slack or bunching in the central portion of the fold.

A further object of this invention is to provide a folder of the character stated in which the progressive changes in the speed of traverse of the carriage are effected through the use of an endless chain drive that is cyclically speeded up and slowed down by an interposed eccentrically mounted sprocket gear that is driven from the main drive.

A further object of this invention is to provide a folder of the character stated that is simple in design, rugged in construction and economical to manufacture.

With these and other objects, the nature of which will become apparent, the invention will be more fully understood by reference to the drawings, the accompanying detailed description and the appended claims.

Figure 1:
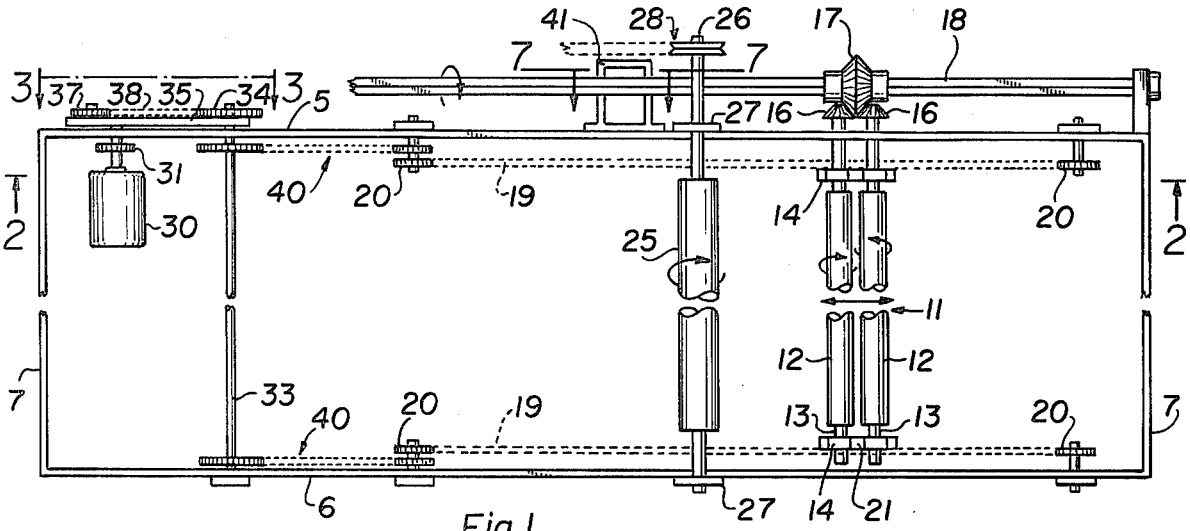
FIG. 1 is a somewhat schematic top plan view of a folder constructed in accordance with this invention, in which the details of the rail-supported traversable guide roll assembly are not shown, nor are the details of the cyclially operable drive for the endless traverse chains.

Referring to the drawings in detail the invention, as illustrated, is embodied in a machine for zig-zag or fan folding a continuously advancing web of textile material and includes a main frame having left and right (as viewed from the left of FIG. 1) spaced parallel upper frame elements 5 and 6 and end frame elements 7, 7.

Figure 2:
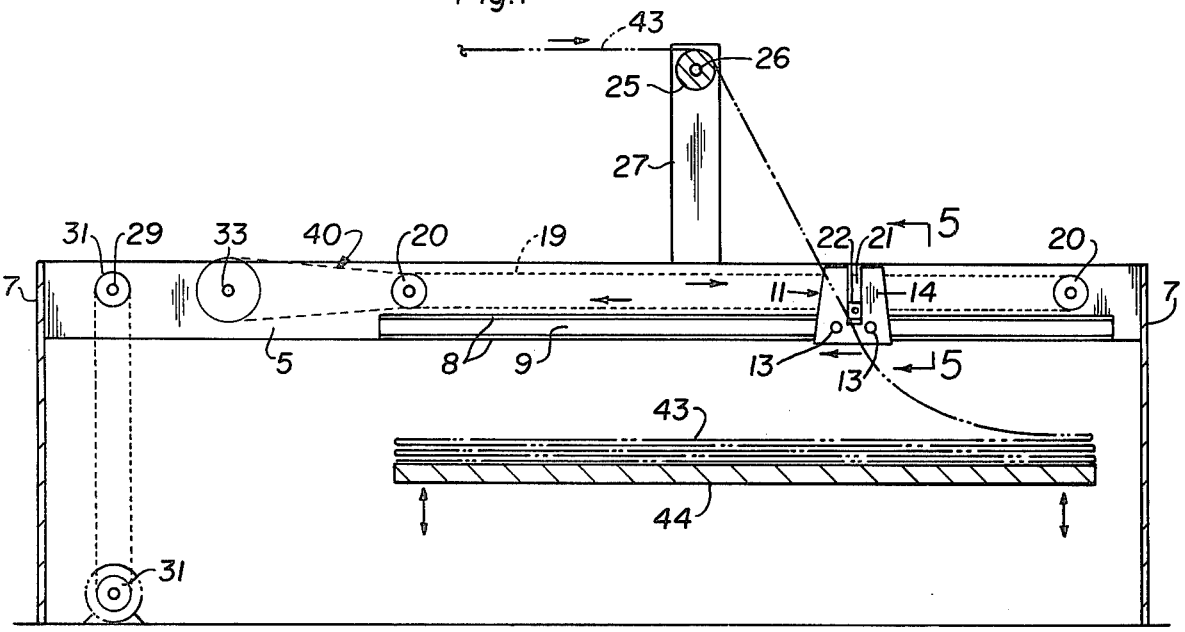
FIG. 2 is a longitudinal vertical section taken along line 2—2 of FIG. 1.
Figure 5:
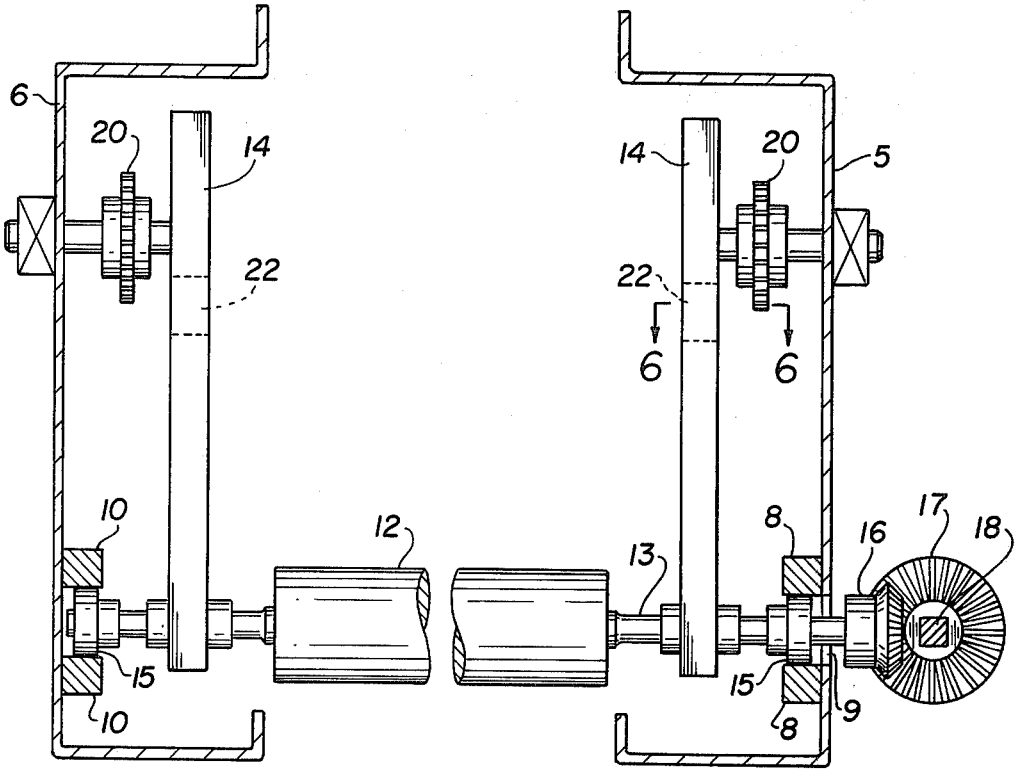
FIG. 5 is a vertical transverse section taken along line 5—5 of FIG. 2.

The frame elements 5 is provided with a pair of inwardly projecting spaced parallel horizontal rails 8, 8 disposed above and below a horizontal slot 9; and the frame element 6 is provided with a similar pair of inwardly projecting rails 10, 10 (see FIGS. 2 and 5).

A transverse guide roll assembly generally indicated 11 is reciprocably supported at its ends by the rails 8 and 10 and includes a pair of parallel guide rolls 12, 12 mounted on shafts 13, 13, the ends of which pass through vertical yokes 14, 14 and are journalled in ball bearing rollers 15, 15 (see FIG. 5) that are slidably and rotatably fitted between the pairs of rails 8, 8 and 10, 10.

One end of each shaft 13 projects through the slot 9 of the frame element 5 and carries a bevel gear 16 for driven engagement by a twin bevel gear 17 interposed between the bevel gears 16 (see (see FIG. 1) and slidably mounted upon a constantly rotating square shaft 18 disposed in parallelism with the path of travel of the bevel gears 16 as the guide roll assembly is reciprocated whereby to positively drive the guide rolls 12, 12 in the same opposed directions and at the same speed regardless of the direction or speed of reciprocation of the guide roll assembly.

It should be noted that while the guide rolls 12, 12 are illustrated as being in spaced parallel relation, they also may be disposed either in close relation or in nip forming relation, depending on the characteristics of the fabric web being folded. In the latter relation, one of the shafts 13 should be spring loaded toward the other in order to provide a yielding nip to accommodate the thickness of the fabric web.

The reciprocation of the guide roll assembly 11 is effected through an endless chain traverse drive that includes a pair of longitudinally disposed endless sprocket or roller chains 19, 19 carried by sprockets 20 rotatably mounted on the frame elements 5 and 6 above the plane of the upper rails 8 and 10 so that the upstanding portions of the yokes 14 may be slidably and pivotally connected to the chains 19 for traverse thereby.

Figure 6:
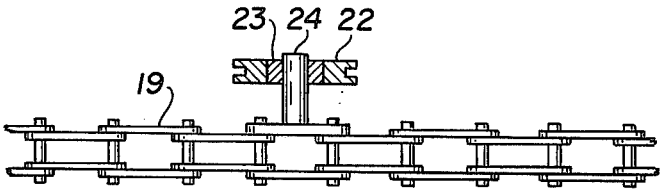
FIG. 6 is a horizontal detail section taken along line 6—6 of FIG. 5 and shows the pivotal connection between one of the endless traverse chains and the slide roller of its associated yoke.

For this latter purpose, each yoke 14 is provided with a centrally located vertical slot 21 (see FIG. 2) which carries a vertically movable slide block 22 provided with a roller 23 rotatably mounted on a stub axle 24 extending laterally from a special connecting link in its associated sprocket chain 19 as shown in FIG. 6 of the drawings.

A centrally located transverse horizontal draw roll 25 is disposed a substantial distance above the plane of the guide roll assembly 11 and is provided with a shaft 26 journalled in a pair of vertical standards 27, 27 affixed to the side frame elements 5 and 6. The draw roll 25 is driven at a predetermined variable speed that is directly related to the speed of reciprocation of the guide roll assembly 11 by any suitable variable speed drive (not shown) as by pulley and belt means generally indicated 28. Alternatively, the delivery end of a fabric conveyor could be located at the position of the draw roll 25 to deliver the fabric web to the guide roll assembly for the folding operation.

As mentioned hereinbefore, the delivery of the fabric being folded upon a receiver must be adjusted in order to avoid a slack or bunched condition in the central portion of each fold. In the folders of the above-mentioned prior art, this central slack or bunched condition of each fold occurs because the speed of delivery from the draw roll to and through the guide rolls is such that the delivery speed is enough to reach the greater distance toward and at the end of each stroke of reciprocation while being too much for the shorter distances during the mid-portion of each stroke of reciprocation.

That condition is overcome in accordance with this invention by driving the traverse chains 19, 19 in such a manner that the speed of reciprocation of the guide roll assembly 11 is progressively speeded up at the beginning of each stroke of reciprocation to a maximum during the mid-portion thereof and progressively reduced as it approaches the end of each stroke of reciprocation, thus resulting in a normal speed of reciprocation during the mid-portion of each stroke and effecting a uniform deposit of the fabric web over the full length of each fold.

Figure 3:
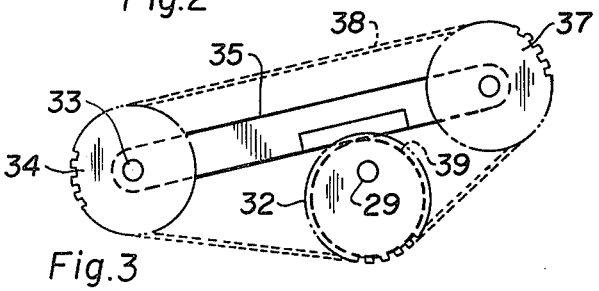
FIG. 3 is an enlarged detail side elevation taken along line 3—3 of FIG. 1 and showing a preferred drive for this endless traverse chains for the guide roll assembly by which the speed of reciprocation thereof is progressively varied during each stroke of reciprocation.
Figure 4:
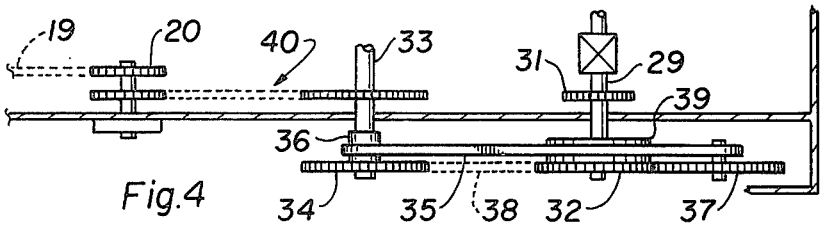
FIG. 4 is a top plan view of the drive shown in FIG. 3 with added details to show the connections to the endless traverse chains for the guide roll assembly.

This desired result is obtained through a continuously operating cyclic drive (see FIGS. 1–4) that includes a first drive shaft 29 that is driven at a constant speed from a main motor 30 through sprocket and chain connections 31. One end of the shaft 29 is provided with an eccentrically mounted sprocket gear 32. A secondary driven shaft 33 is disposed in spaced parallel relation to the shaft 29 and is provided at one end with a sprocket gear 34 lying in the same plane as the eccentric gear 32. A rock arm or pitman 35 is provided at one end with a boss 36 journalled on the driven shaft 33 and has its free end extending above and to the right of the drive shaft 29 as viewed in FIG. 3 of the drawings. The free end of the arm 35 is provided with an idler sprocket gear 37 lying in the same plane as that containing the gears 32 and 34 and all three gears are interconnected by an endless sprocket or roller chain 38.

An eccentric disc or cam 39 is secured to one face of the eccentric gear 32 and its eccentricity is angularly oriented the same as that of the gear 32. The mid-portion of the rock arm 35 is in following contact with the rim of the cam 39 so that the arm oscillates in synchronization with the rotation of the eccentric gear 32 to keep the chain 38 under constant tension as the secondary shaft 33 is driven at cyclically varying speeds through its sprocket gear 34 as the result of the eccentricity of the gear 32.

The cyclic variations in the speed of the shaft 33 are transmitted to the traverse chains 19 of the guide roll assembly by sprocket and chain connections generally indicated 40, thus causing the traverse chains to cyclically speed up and slow down and effect a corresponding progressive speeding up and slowing of the guide roll assembly at the end portions of each stroke of reciprocation while maintaining its normal speed during the mid-portion of each stroke.

The variations in the speed and direction of reciprocation of the guide roll assembly 11 do not have any effect on either the speed or direction of rotation of the guide rolls 12, 12 because, as described above, they are always constantly and positively driven at the same speed and in the same opposed directions by the bevel gears 16 and 17 from the constantly rotating shaft 18, which may be driven from the main motor 30 through any suitable variable speed right-angle take off drive (not shown).

Figure 7:
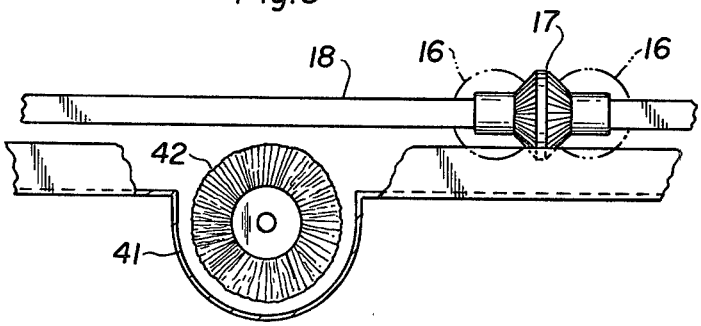
FIG. 7 is a detail longitudinal section taken along line 7—7 FIG. 1 and shows the brush applicator for applying lubricant to the twin bevel sliding gear that drives the guide rolls.

Provision is also made to lubricate the twin bevel gear 17 and, through it, the bevel gears 16, 16. For this purpose an open top lubricant reservoir 41 (see FIGS. 1 and 7) is affixed to the frame element 5 below the shaft 18 at a location about midway of the reciprocation of the guide roll assembly 11 and is provided with a circular applicator brush 42 journalled about an axis that is horizontally normal to the axis of the shaft 18. The lower portion of the brush 42 is contained within the reservoir 41 for pick-up of lubricant and the upper portion of the brush is in intersection with the path of travel of the twin bevel gear 17 so that that gear and its associated bevel gears 16, 16 receive lubrication once during each stroke of reciprocation of the guide roll assembly.

In operation, a fabric web 43 is withdrawn from a supply source over the draw roll 25 and directed downwardly between the guide rolls 12, 12 for folding deposition upon a receiver 44, which preferably should be a so-called drop table that is progressively lowered as successive folds are completed in order that the plane of each new fold will be substantially that of each preceding fold, thus assuring a uniform lay down of each fold as the guide roll assembly is reciprocated at its cyclically varying speeds. The speed of the draw roll 25 should be such that the fabric web is properly deposited on the receiver at the shorter distances to the mid-portion of each fold as the guide roll assembly is traversed at its top speed, thus allowing a relatively greater time for the uniform deposition of the fabric web on the receiver at the end portions of each stroke of reciprocation of the guide roll assembly as the result of the progressive increase and decrease in speed of that assembly at the end portions of each stroke of recriprocation.

However, even if a drop table is not used as a receiver and the fabric is folded on or into a fixed lowerly located receiver, the operative benefits of the folder of this invention still will be attained to a substantial degree because the slack or bunched condition at the central portion of each fold will be minimized.

Thus, the folder of this invention may be employed at any place in a textile mill processing line and is particularly effective at the end of a processing line where the folded goods are to be packaged for shipment to a converter.

In further reference to the operation, it will be understood that the yokes 14 of the guide roll assembly 11 do not and cannot oscillate about any transverse axis because they are journalled on the spaced parallel shafts 13, 13 of the guide rolls 12, 12, which shafts are always maintained in the same horizontal plane by the rollers 15, 15 that are restrained against vertical motion by the rails 8, 8 and 10, 10 between which they ride.

It is, of course, to be understood that variations in arrangements and proportions of parts may be made within the scope of the appended claims.

I claim:

1. In a folder for a continuously advancing fabric web; a pair of horizontal longitudinally extending spaced parallel frame members; a transverse guide roll assembly supported by said frame members for reciprocation therealong and including a pair of rotatable guide rolls; said guide rolls being rotated at a substantially uniform speed; transverse draw roll fixedly mounted on said frame members in a plane above that of said guide rolls for advancing the fabric web to said guide roll assembly; means for driving said draw-roll at a substantially uniform speed; and continuously operable cyclic means for both reciprocating said guide roll assembly and for progressively increasing the speed of reciprocation thereof at the beginning portion of each stroke of reciprocation to a maximum speed during the middle portion of each said stroke and then progressively slowing the speed of reciprocation thereof as said assembly approaches the end of each said stroke.

2. The folder of claim 1 additionally including means for causing said guide rolls to be driven in the same opposed directions of rotation regardless of the direction of reciprocation of said guide roll assembly, said means for causing said guide rolls to be driven in the same opposed directions including means for continuously and positively driving said guide rolls at the same rotational speed regardless of any variations in the speeds of reciprocation of said guide roll assembly.

3. The folder of claim 2 in which each of said guide rolls is mounted on a shaft having an end provided with a driven gear affixed thereto and in which the gears of said guide rolls are positively driven by a gear in mesh therewith and sidably mounted on a constantly driven shaft disposed in parallelism with the path of travel of said guide roll gears as said guide roll assembly is reciprocated.

4. The folder of claim 3 in which said cyclic means includes a driven endless traverse chain provided with a laterally projecting stub axle affixed to a link thereof; and yoke and slide connections extending between the shaft of said guide rolls and said stub axle, said yoke being supported solely by the shafts of said guide rolls for reciprocation parallel to said endless traverse chain without oscillation with respect thereto.

5. In a method of fan folding a continuously advancing web of textile wherein said web is delivered to a folder by fixedly located delivery means operating at a substantially constant predetermined speed for advancing said web downwardly and then fan folded onto a horizontal receiver by being directed downwardly between a pair of rotatable guide rolls that are bodily reciprocated along a horizontal path lying in a plane above said receiver and below said delivery means; said guide rolls being rotated at a substantially uniform speed the improvement which comprises reciprocating said guide rolls in such a manner that during each stroke of reciprocation the speed of reciprocation is progressively increased from the momentary stop at the beginning portion of the stroke to a maximum speed during the mid-portion of the stroke and then progressively decreased during the remaining portion of the stroke before reaching the momentary stop at the end thereof, whereby to effect a uniform lay down of each fold of said web onto said receiver regardless of the changing distances between said fixedly located delivery means and said guide rolls as said guide rolls are horizontally reciprocated.

6. A folder for continuously advancing fabric web and including a pair of horizontal longitudinally extending spaced parallel frame members each provided with at least one horizontal rail for reciprocably supporting a guide roll assembly; a transverse horizontal guide roll assembly movably supported at each end by said rails and including a pair of parallel rotatable guide rolls; means for reciprocating said guide roll assembly along said rails and including an endless traverse chain drive operably connected to said guide roll assembly; and means for driving said endless traverse chain comprising a first drive shaft, a secondary driven shaft disposed in spaced parallel relation to said first drive shaft and operably connected to said traverse chain drive, a rock arm having one end journalled on said secondary driven shaft and a free end extending to a location in proximity to said first drive shaft, said first drive shaft being provided with an eccentrically mounted sprocket gear affixed thereto, said secondary driven shaft being provided with a sprocket gear affixed thereto and the free end of said rock arm being provided with an idler sprocket gear rotatably mounted thereon, all of said sprocket gears lying in the same plane, an endless drive chain interconnecting all of said sprocket gears, and a cam rotatable with said eccentrically mounted sprocket gear for oscillating said rock arm in synchronization therewith, said rock arm having an intermediate portion in following contact with said cam whereby to maintain said endless drive chain in a condition of constant tension while driving said secondary driven shaft and said endless traverse chain at cyclically varying speeds.

7. The folder of claim 6 additionally including means for continuously and positively driving said guide rolls in the same opposed directions and at the same rotational speed regardless of the direction of reciprocation of said guide roll assembly and regardless of any variations in the speeds of reciprocation thereof.

8. The folder of claim 6 in which each of said guide rolls is mounted on a shaft having an end provided with a driven gear affixed thereto and in which the gears of said guide rolls are positively driven by a gear in mesh therewith and slidably mounted on a constantly driven drive shaft disposed in parallel with the path of travel of said guide roll gears as said guide roll assembly is reciprocated.

9. The folder of claim 8 in which said guide roll gears are bevel gears and in which said slidably mounted gear is a twin bevel gear interposed between said guide roll gears.

10. The folder of claim 9 additionally including means for lubricating said slidably mounted gear.

11. The folder of claim 10 in which said lubricating means includes a fixed lubricant reservoir mounted beneath the path of travel of said slidably mounted gear, and a freely rotatable circular applicator mounted with its axis horizontally normal to the path of travel of said slidably mounted gear, said applicator having a lower portion immersed in lubricant contained in said reservoir and an upper portion extending above said reservoir for contact by said slidably mounted gear each time said gear moves past said reservoir.

12. The folder of claim 6 additionally including means for positively driving said guide rolls in the same opposed directions of rotation regardless of the direction of reciprocation of said guide roll assembly.

13. The folder of claim 12 additionally including a transverse horizontal draw roll rotatably mounted in a plane above that of said guide rollers, and means for driving said draw roll.

* * * * *